US009972455B2

(12) United States Patent
Ren

(10) Patent No.: US 9,972,455 B2
(45) Date of Patent: May 15, 2018

(54) BUTTON AND KEYBOARD DEVICE

(71) Applicant: COOLER MASTER TECHNOLOGY INC., New Taipei (TW)

(72) Inventor: Da-Zhi Ren, New Taipei (TW)

(73) Assignee: Cooler Master Technology Inc., New Taipei (TW)

( * ) Notice: Subject to any disclaimer, the term of this patent is extended or adjusted under 35 U.S.C. 154(b) by 0 days. days.

(21) Appl. No.: 15/376,950

(22) Filed: Dec. 13, 2016

(65) Prior Publication Data

US 2017/0194109 A1 Jul. 6, 2017

(30) Foreign Application Priority Data

Dec. 31, 2015 (CN) ..... 2015 1 1031754

(51) Int. Cl.

| | |
|---|---|
| ***H01H 9/26*** | (2006.01) |
| ***H01H 13/72*** | (2006.01) |
| ***H01H 13/76*** | (2006.01) |
| ***H01H 3/12*** | (2006.01) |
| ***H01H 3/32*** | (2006.01) |
| ***H01H 13/14*** | (2006.01) |

(52) U.S. Cl.

CPC ..... *H01H 3/122* (2013.01); *H01H 3/32* (2013.01); *H01H 13/14* (2013.01)

(58) Field of Classification Search

CPC .. H01H 3/00; H01H 3/02; H01H 3/04; H01H 3/12; H01H 3/32; H01H 9/00; H01H 9/02; H01H 13/00; H01H 13/04; H01H 13/12; H01H 13/20; H01H 13/26; H01H 13/50; H01H 13/70; H01H 13/7006; H01H 2003/00; H01H 2003/02; H01H 2003/12; H01H 2013/02; H01H 2013/00; H01H 2013/50; H01H 2239/056; H01H 3/122; H01H 3/14

USPC ..... 200/5 A, 344, 517, 341, 345; 400/490, 400/491, 491.2, 495, 495.1, 496

See application file for complete search history.

(56) References Cited

U.S. PATENT DOCUMENTS

| | | | | |
|---|---|---|---|---|
| 7,102,087 B2 * | 9/2006 | Chun | ..... | H01H 13/7065 200/302.1 |
| 2011/0226600 A1 * | 9/2011 | Lo | ..... | H01H 3/122 200/5 A |

FOREIGN PATENT DOCUMENTS

| | | |
|---|---|---|
| CN | 203434056 U | 2/2014 |
| TW | M268664 | 6/2005 |
| TW | M400024 | 3/2011 |

* cited by examiner

*Primary Examiner* — Anthony R. Jimenez
(74) *Attorney, Agent, or Firm* — Muncy, Geissler, Olds & Lowe, P.C.

(57) ABSTRACT

A button includes a base, a plurality of restricting members, a cap and a linking member. The base includes two positioning holes disposed on two sides of the base, respectively. Each of the restricting members includes an engaging portion, and the engaging portions are disposed corresponding to the positioning holes, respectively. The cap is disposed opposite to the base and connected with the restricting members. The linking member is disposed on the base, two ends of which are connected with the engaging portions, respectively. The engaging portions drive the linking member to rotate and are respectively inserted into the positioning holes when the cap moves toward a direction of the base. A keyboard device including the button is also disclosed.

26 Claims, 5 Drawing Sheets

BUTTON AND KEYBOARD DEVICE

CROSS REFERENCE TO RELATED APPLICATIONS

This Non-provisional application claims priority under 35 U.S.C. § 119(a) on Patent Application No(s). 201511031754.4 filed in People's Republic of China on Dec. 31, 2015, the entire contents of which are hereby incorporated by reference.

BACKGROUND OF THE INVENTION

Field of Invention

This invention relates to a button and a keyboard device and, in particular, to a button and a keyboard device, which can be avoided from getting into a loose or sway state when being pressed.

Related Art

Due to the development of the electronic technology as well as the convenience brought thereby, many electronic products, such as personal computers, notebook computers, cell phones or other kinds of button-type input devices, provide keyboards for the user's input and operation.

The buttons on the keyboard are mostly square and cap-like, whereas a small part of the buttons, such as "Space" button, "Enter" button" or "Shift" button, having a length greater than its width is called a multiple button. However, since the cap of the multiple button has a length greater than its width, the user will be given a loose, sway and not tight operation when pressing the button.

SUMMARY OF THE INVENTION

An objective of this invention is to provide a button and a keyboard device, which can be avoided from getting into a loose or sway state when being pressed.

A button disclosed by this invention includes a base, a plurality of restricting members, a cap and a linking member. The base includes two positioning holes disposed on two sides of the base, respectively. Each of the restricting members includes an engaging portion, and the engaging portions are disposed corresponding to the positioning holes, respectively. The cap is disposed opposite to the base and connected with the restricting members. The linking member is disposed on the base, two ends of which are connected with the engaging portions, respectively. The engaging portions drive the linking member to rotate and are respectively inserted into the positioning holes when the cap moves toward a direction of the base.

In one embodiment, the restricting member further includes a first embedment portion connected with the engaging portion, the cap includes a plurality of first protruding portions, each of the first protruding portions includes a first trough, and the first trough is disposed corresponding to the first embedment portion.

In one embodiment, the restricting member further includes an extension portion, and the engaging portion and the first embedment portion are connected with two ends of the extension portion, respectively.

In one embodiment, an extending direction of the extension portion is the same as that of a length side of the cap.

In one embodiment, a length of the cap corresponds to that of the extension portion.

In one embodiment, the button further comprises a carrier and an actuating member. The carrier member is fixed to the base. The actuating member is slidably disposed on the carrier member. The actuating member includes a second embedment portion, the cap further includes a second protruding portion having a second trough, and the second trough is disposed corresponding to the second embedment portion.

In one embodiment, the second protruding portion is disposed in the second embedment portion and disposed against the cap.

In one embodiment, the second protruding portion drives the actuating member to move and thus to be inserted into the carrier member when the cap moves toward the direction of the base.

In one embodiment, each of two ends of the linking member includes an embedment section inserted into the engaging portion.

In one embodiment, the linking member further includes two transition sections, two extension sections and a bend section, the bend section is connected with the extension sections, and each of the transition sections is connected with the corresponding embedment section and the corresponding extension section.

In one embodiment, the base further includes two protruding limiting portions and the extension sections are engaged with the limiting portions, respectively.

In one embodiment, when the cap moves toward the direction of the base, the restricting members drive the linking member to rotate so as to make the bend section contact the carrier member.

In one embodiment, the engaging portion includes a pair of fixing arms which are approximately parallel with each other and flexible, and a distance between the pair of the fixing arms is smaller than a radial length of the embedment section.

A keyboard device is further disclosed by this invention and includes a plurality of buttons which can be any button as mentioned above.

As mentioned above, in the button and the keyboard device of the invention, by the engaging portions of the restricting members disposed corresponding to the positioning holes of the base, the restricting members can limit the movement of the cap when the cap is pressed toward the direction of the base to move. Besides, by the engaging portions of the restricting members respectively inserted into the positioning holes of the base, the movement of the restricting members can be limited as well as the movement of the cap. Therefore, in comparison with the prior art, the button and the keyboard of this invention are improved so that the cap can be avoided from getting into a loose, sway or not tight state when being pressed.

BRIEF DESCRIPTION OF THE DRAWINGS

The invention will become more fully understood from the detailed description and accompanying drawings, which are given for illustration only, and thus are not limitative of the present invention, and wherein.

DETAILED DESCRIPTION OF THE INVENTION

The present invention will be apparent from the following detailed description, which proceeds with reference to the accompanying drawings, wherein the same references relate to the same elements.

With reference to the related figures, the buttons and the keyboard devices using the buttons of the embodiments of the invention are illustrated, wherein the same component is given the same reference sing for the illustration. The figures of all the embodiments of the invention are just for the illustration but not for showing real dimension and size ratio. Besides, the orientation terms such as "above", "below", "up" and "down" mentioned in the embodiments are just for showing the relative position relationship. Moreover, when a component is formed on, above, below or under another component, this at least means that the component directly contacts the another component, or that a further component is disposed between the component and the another component so that the component does not directly contact the another component.

Figure 1A:
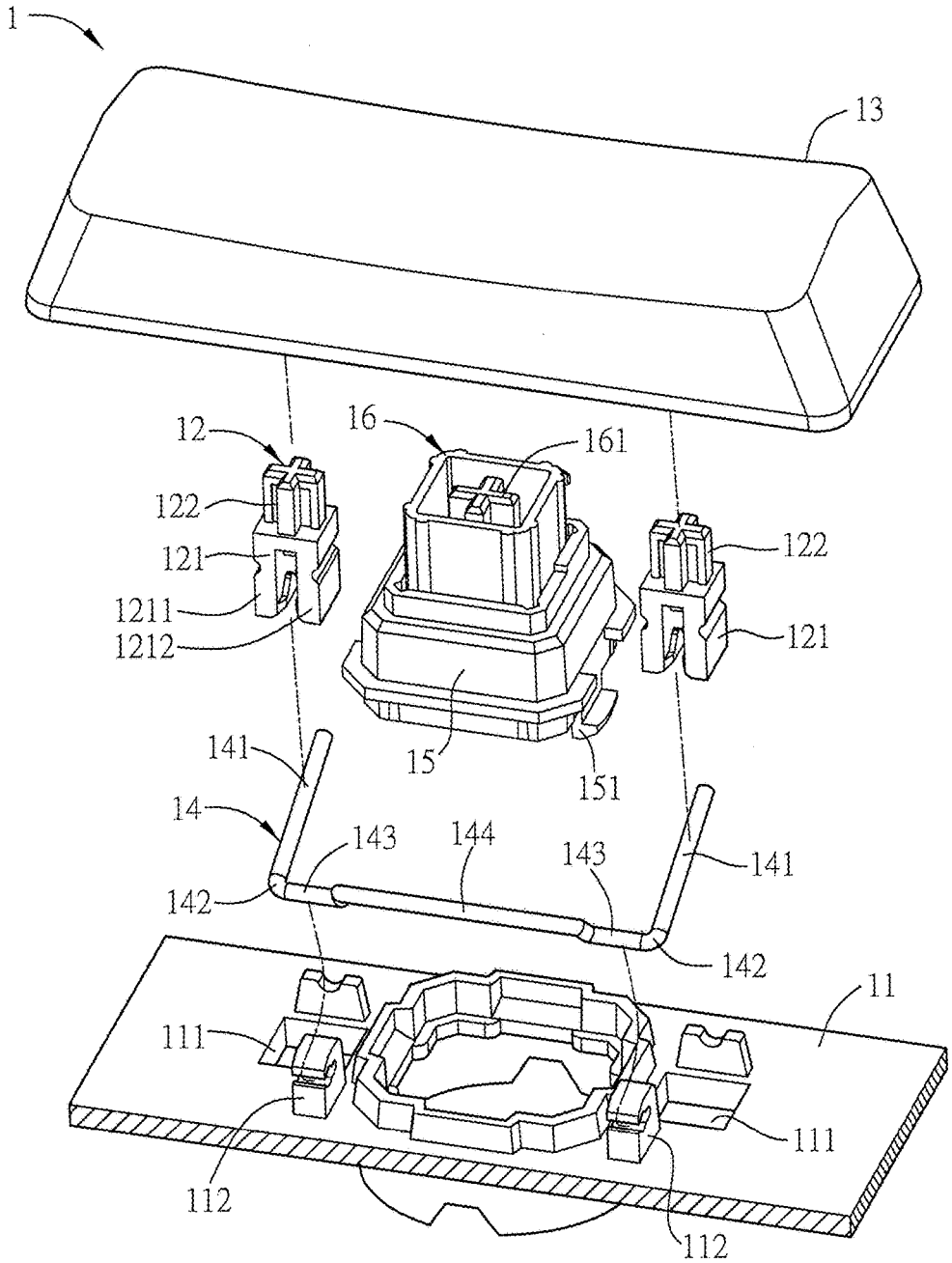
FIGS. 1A and 1B are an exploded schematic diagram and an assembly schematic diagram of a button of an embodiment of the invention, respectively.
Figure 1B:
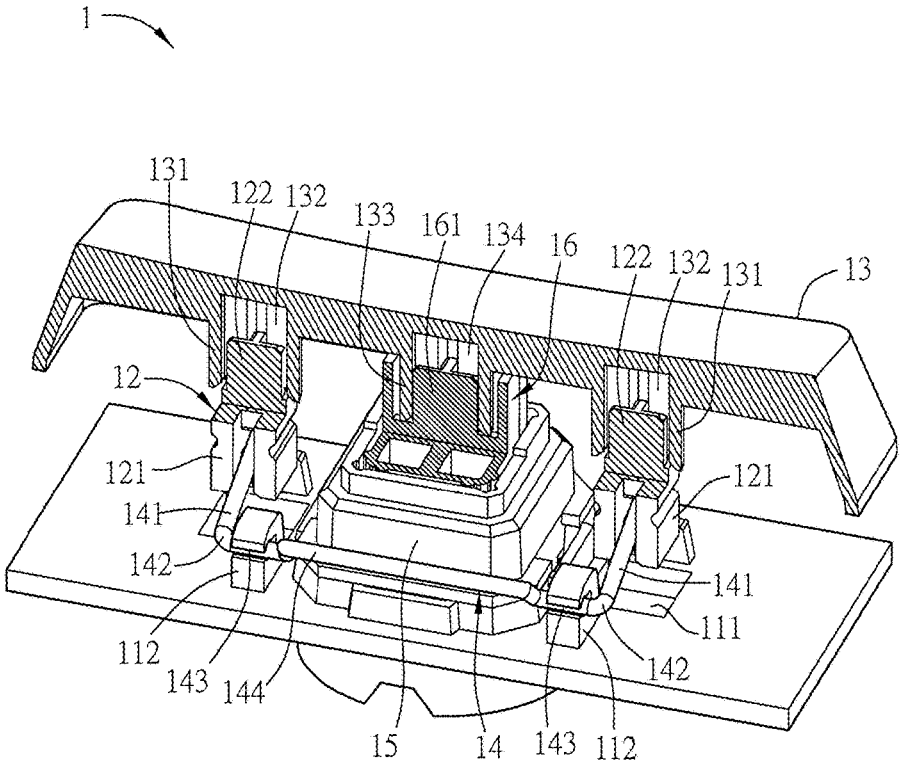

Please refer to FIGS. 1A and 1B, which are an exploded schematic diagram and an assembly schematic diagram of a button 1 of an embodiment of the invention, respectively.

For clearly showing the structure of the button 1, a restricting member 12 and a cap 13 in FIG. 1B are give as a partial cross-section. The button 1 of this embodiment can be applied to, for example but not limited to, the button structure of a thin-film type, a mechanical type or a half-mechanical type. Besides, the button 1 can be a multiple button (having a cap with a length greater than its width) for example and can be a multiple button on a keyboard, such as a "Enter" button, a "Shift" button, a "Backspace" button or a "Space" button or other buttons.

As shown in FIGS. 1A and 1B, the button 1 includes a base 11, a plurality of restricting members 12, a cap 13 and a linking member 14.

The base 11 includes two positioning holes 111, which are disposed on two sides of the base 11, respectively. Moreover, the base 11 further includes two limiting portions 112 protruding from a surface, and each of the limiting portions 112 has a recess.

Herein, the number of the restricting members 12 is two. Each of the restricting members 12 includes an engaging portion 121, and the engaging portions 121 are disposed corresponding to the positioning holes 111, which means, herein, a size of the restricting member 12 is smaller than or equal to that of the positioning hole 111 so that the restricting member 12 can be inserted into the positioning hole 111 so as to be positioned when moving downwards. Thereby, the route or the distance of the movement of the restricting member 12 can be limited. Besides, the restricting member 12 of this embodiment further includes a first embedment portion 122 connecting with the engaging portion 121. Herein, the first embedment portion 122 is disposed on the engaging portion 121 so as to directly connecting with the engaging portion 121.

The cap 13 is disposed opposite to the base 11 and is connected with the restricting members 12. As shown in FIG. 1B, the cap 13 of this embodiment is disposed against the restricting members 12 and includes two first protruding portions 131, each of which includes a first trough 132 disposed corresponding to the first embedment portion 122. The first embedment portion 122 has, for example but not limited to, a crisscross cross-section. The form of the first trough 132 corresponds to the first embedment portion 122. The first trough 132 can have a crisscross cross-section so that the first embedment portion 122 can be embedded into the first trough 132. When the two first embedment portions 122 are disposed corresponding to the two first troughs 132, the movement of the cap 13 is limited, so that the cap 13 during the movement can be tight in connection with the restricting members without looseness.

The linking member 14 is disposed on the base 11, and two ends of the linking member 14 are connected with the engaging portions 121, respectively. Herein, the linking member 14 is, for example, a metal bar or an alloy bar, and two ends of the linking member 14 are embedded into (or made passing through) the engaging portions 121 so as to be connected with the engaging portions 121. In this embodiment, the linking member 14 has an embedment section 141 at each of the two ends, and linking member 14 is connected with the restricting members 12 through the embedment sections 141 embedded into the engaging portions 121.

The linking member 14 further includes two transition sections 142, two extension sections 143 and a bend section 144. The bend section 144 is connected with the extension sections 143, and that is, the extension sections 143 are connected with two ends of the bend section 144, respectively. Besides, two ends of each of the transition sections 142 are connected with the corresponding embedment section 141 and the corresponding extension section 143, respectively, so that the linking member 14 has a U-shaped form. Moreover, by the extension sections 143 embedded into the limiting portions 112, the manner of the movement of the linking member 14 is limited. The limiting portions 112 of this embodiment can limit the linking member 14 to rotate toward a direction (such as a downward direction). Therefore, when the cap 13 is pressed toward the direction of the base 11 to move, the first protruding portions 131 can drive the first embedment portions 122 and the engaging portions 121 of the restricting members 12 to move downwards and also drive the linking member 14, and thus the engaging portions 121 are inserted into the positioning holes 111, respectively.

In this embodiment, the engaging portion 121 of the restricting member 12 includes a pair of fixing arms 1211, 1212, which are approximately parallel with each other. In some embodiments, a distance between the fixing arms 1211 and 1212 can be smaller than a radial length of the embedment section 141 (the diameter of the embedment section 141 in this embodiment), but this invention is not limited thereto. Moreover, the engaging portion 121 is preferably flexible. Therefore, when the embedment section 141 is embedded into the engaging portion 121, the fixing aims 1211 and 1212 will be bent outwards so that the embedment section 141 can be smoothly embedded into the engaging portion 121. Because the distance between the fixing arms 1211 and 1212 is smaller than a radial length of the embedment section 141, the fixing arms 1211 and 1212 will tightly clip the embedment section 141, so that the embedment section 141 will not sway in the engaging portion 121 and the balance state of the cap 13 can be kept when being pressed.

The button 1 of this embodiment further includes a carrier member 15 and an actuating member 16. The carrier member 15 is fixed to the base 11 and located between the two positioning holes 111. Herein, as shown in FIG. 1A, the carrier member 15 includes at least one engaging portion 151, and the carrier member 15 is fixed to the base 11 by the engaging portion 151 engaged with the base 11. Moreover, the actuating member 16 is disposed against the cap 13 and is slidably disposed on the carrier member 15. The actuating member 16 includes a second embedment portion 161, and the cap 13 further includes a second protruding portion 133. The second protruding portion 133 includes a second trough 134, which is disposed corresponding to the second embedment portion 161. Herein, the second protruding portion 133 is disposed at the middle part of the cap 13 and inserted into the actuating member 16, so that the second embedment portion 161 is embedded into the second trough 134. The second embedment portion 161 of this embodiment also has a crisscross cross-section. The second trough 134 also has a form corresponding to the second embedment portion 161. Herein, the second trough 134 also has a crisscross cross-section. Therefore, by the second embedment portion 161 disposed corresponding to the second trough 134, the manner of the downward movement of the cap 13 is also limited, so that the cap 13 can be tight in connection with the actuating member 16 without looseness. Moreover, the actuating member 16 and the carrier member 15 can have a relative movement. When the cap 13 is pressed toward the direction of the base 11 to move, the second protruding portion 133 can drive the actuating member 16 to move downwards and thus to be inserted into the carrier member 15, and therefore the contact (not shown) disposed inside the carrier member 15 can be provided with an electrical connection.

Therefore, when the cap 13 of the button 1 is pressed downwards, the cap 13 will drive the restricting members 12 and further drive the embedment section 141 of the linking member 14 to move downwards, and meanwhile, the engaging portions 121 are also inserted into the positioning holes 111, respectively. Moreover, because the embedment sections 141 of the linking member 14 move downwards, the linking member 14 can just do a rotating movement due to the limitation of the two limiting portions 112. Hence, the bend section 144 is rotated so as to be disposed against the carrier member 15. The rotation range of the linking member 14 can be limited by the bend section 144 and the carrier member 15. In other words, when the cap 13 moves toward the direction of the base 11, the embedment sections 141 move downwards to cause the linking member 14 to rotate around the limiting portion 112 as pivot until the bend section 144 contacts the carrier member 15 (this also limits the distance of the downward movement of the cap 13). When the user releases the button 1, the cap 13 can be made moving toward the direction away from the base 11 and moving back to the original position by a spring member (not shown) disposed inside the carrier member 15.

Accordingly, in this embodiment, by the engaging portions 121 of the restricting members 12 respectively disposed corresponding to the positioning holes 111 of the base 11, the restricting members 12 can limit the movement of the cap 13 when the cap 13 is pressed toward the direction of the base 11 to move. Besides, by the engaging portions 121 of the restricting members 12 respectively inserted into the positioning holes 111, the movements of the restricting members 12 and the cap 13 also can be limited. Therefore, in comparison with the prior art, the button 1 is improved so that the cap 13 can be avoided from getting into a loose or sway state when being pressed.

Figure 2A:
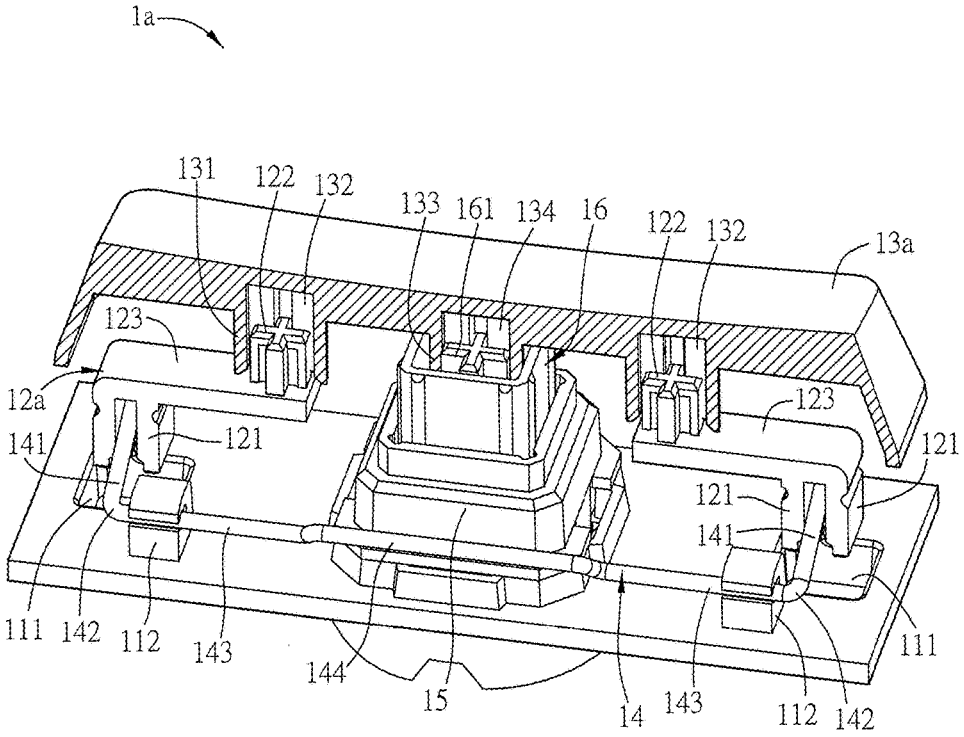
FIGS. 2A and 2B are schematic diagrams of a button of another embodiment of the invention before and after being pressed, respectively.
Figure 2B:
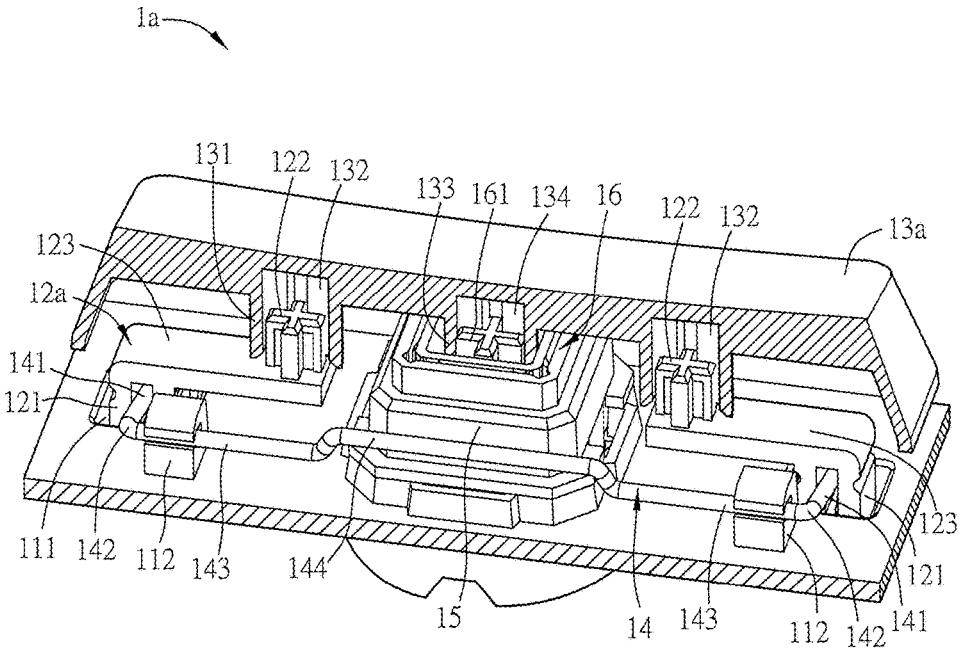

Please refer to FIGS. 2A and 2B, which are schematic diagrams of a button 1*a* of another embodiment of the invention before and after being pressed, respectively.

The main difference between the button 1*a* of FIG. 2A and the button 1 is in that a width of the cap 13*a* of the button 1*a* is greater than that of the cap 13 of the button 1. For example, the button 1*a* is a "Space" button. In response to the width of the cap 13*a*, the restricting member 12*a* of the button 1*a* of this embodiment further includes an extension portion 123 (or called a resistance arm) extending horizontally, and the engaging portion 121 and the first embedment portion 122 are connected with two ends of the extension portion 123, respectively. An extending direction of the extension portion 123 is the same as that of a length side of the cap 13*a*, i.e. the horizontal direction. Moreover, a length of the cap 13*a* corresponds to that of the extension portion 123. In other words, in response to different lengths of different multiple buttons, the extension portion 123 can be designed with different lengths. Therefore, a designer can design the length of the extension portion 123 based on the length of the cap 13*a* (the longer the length of the cap 13*a*, the longer the length of the extension portion 123). Moreover, in response to the disposition of the extension portion 123, the extension section 143 of the linking member 14 of this embodiment is also made longer. Besides, the first protruding portion 131 of the cap 13*a* of this embodiment is disposed against the extension portion 123. By the design of the extension portion 123, the user can receive a better feedback feel when pressing the button 1*a*.

Other technical features of the button 1*a* can be comprehended by referring to the same components of the button 1, and the related illustration is omitted for conciseness.

Figure 3:
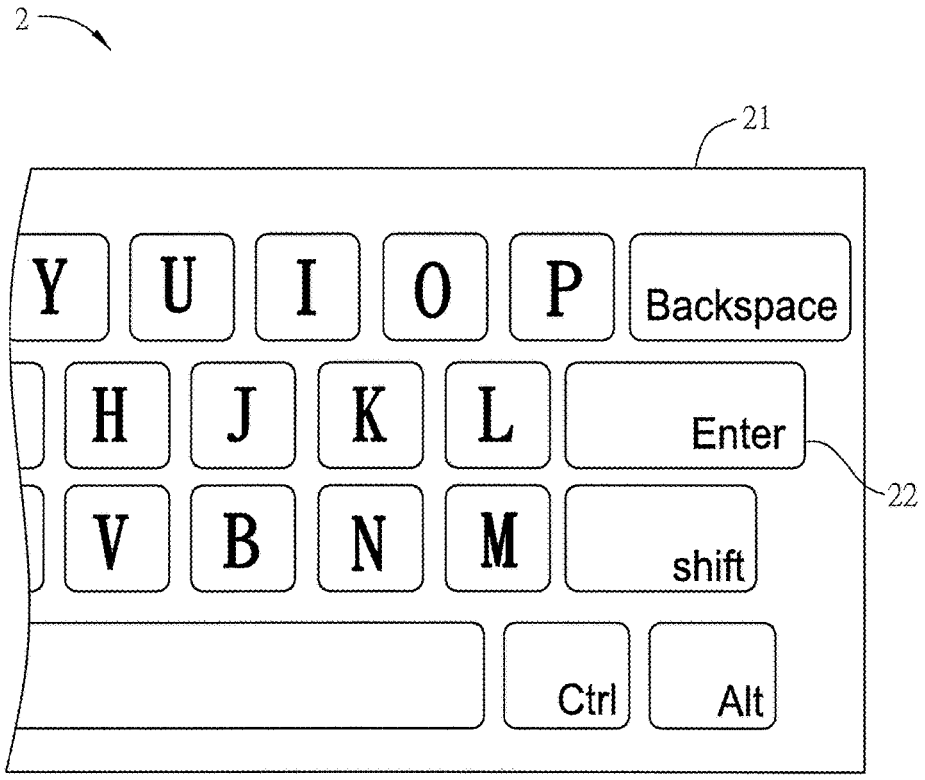
FIG. 3 is a schematic diagram of a keyboard device of an embodiment of the invention.

Please refer to FIG. 3, which is a schematic diagram of a keyboard device 2 of an embodiment of the invention. The keyboard device 2 is, for example but not limited to, a keyboard of a personal computer.

The keyboard device 2 includes a casing 21 and a plurality of buttons 22, and the buttons 22 are disposed in the casing 21 and protrude from the casing 21. At least one of the buttons 22 can be a multiple button, such as a "Enter" button, a "Shift" button, a "Backspace" button or a "Space" button or other buttons, but this invention is not limited thereto. Herein, the buttons 22 can have the technical features of the above-mentioned button 1 or 1*a* or their variations and can be comprehended by referring to the above illustration, so the description thereof is omitted here for conciseness.

In summary, in the button and the keyboard device of the invention, by the engaging portions of the restricting members disposed corresponding to the positioning holes of the base, the restricting members can limit the movement of the cap when the cap is pressed toward the direction of the base to move. Besides, by the engaging portions of the restricting members respectively inserted into the positioning holes of the base, the movement of the restricting members can be limited as well as the movement of the cap. Therefore, in comparison with the prior art, the button and the keyboard of this invention are improved so that the cap can be avoided from getting into a loose, sway or not tight state when being pressed.

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. A button, comprising:

a base including two positioning holes disposed on two sides of the base, respectively;

a plurality of restricting members, each of which includes an engaging portion, the engaging portions being disposed corresponding to the positioning holes, respectively;

a cap disposed opposite to the base and connected with the restricting members; and a linking member disposed on the base, two ends of which are connected with the engaging portions, respectively;

wherein the engaging portions drive the linking member to rotate and are respectively inserted into the positioning holes when the cap moves toward a direction of the base.

2. The button as recited in claim 1, wherein in each of the restricting members, the restricting member further includes a first embedment portion connected with the engaging portion of the same restricting member, the cap includes a plurality of first protruding portions, each of the first protruding portions includes a first trough disposed corresponding to the first embedment portion.

3. The button as recited in claim 1, wherein in each of the restricting members, the restricting member further includes a first embedment portion and an extension portion, and the engaging portion of the same restricting member and the first embedment portion are connected with two ends of the extension portion, respectively, wherein the cap includes a plurality of first protruding portions, each of the first protruding portions includes a first trough disposed corresponding to the first embedment portion.

4. The button as recited in claim 3, wherein an extending direction of the extension portion is the same as that of a length side of the cap.

5. The button as recited in claim 3, wherein a length of the cap corresponds to that of the extension portion.

6. The button as recited in claim 1, further comprising:

a carrier member fixed to the base; and an actuating member slidably disposed on the carrier member, wherein the actuating member includes a second embedment portion, the cap further includes a second protruding portion having a second trough, and the second trough is disposed corresponding to the second embedment portion.

7. The button as recited in claim 6, wherein the second protruding portion is disposed in the second embedment portion and disposed against the cap.

8. The button as recited in claim 6, wherein the second protruding portion drives the actuating member to move and thus to be inserted into the carrier member when the cap moves toward the direction of the base.

9. The button as recited in claim 6, wherein each of two ends of the linking member includes an embedment section inserted into one of the engaging portions.

10. The button as recited in claim 9, wherein the engaging portion includes a pair of fixing arms which are approximately parallel with each other and flexible, and a distance between the pair of the fixing arms is smaller than a radial length of one of the embedment sections.

11. The button as recited in claim 9, wherein the linking member further includes two transition sections, two extension sections and a bend section, the bend section is connected with the extension sections, and each of the transition sections is connected with one of the embedment sections and one of the extension sections.

12. The button as recited in claim 11, wherein the base further includes two protruding limiting portions and the extension sections are engaged with the limiting portions, respectively.

13. The button as recited in claim 11, wherein when the cap moves toward the direction of the base, the restricting members drive the linking member to rotate so as to make the bend section contact the carrier member.

14. A keyboard device, comprising:

at least one button including:

a base including two positioning holes disposed on two sides of the base, respectively;

a plurality of restricting members, each of which includes an engaging portion, the engaging portions being disposed corresponding to the positioning holes, respectively;

a cap disposed opposite to the base and connected with the restricting members; and a linking member disposed on the base, two ends of which are connected with the engaging portions, respectively;

wherein the engaging portions drive the linking member to rotate and are respectively inserted into the positioning holes when the cap moves toward a direction of the base.

15. The keyboard device as recited in claim 14, wherein in each of the restricting members, the restricting member further includes a first embedment portion connected with the engaging portion of the same restricting member, the cap includes a plurality of first protruding portions, each of the first protruding portions includes a first trough disposed corresponding to the first embedment portion.

16. The keyboard device as recited in claim 14, wherein in each of the restricting members, the restricting member further includes a first embedment portion and an extension portion, and the engaging portion of the same restricting member and the first embedment portion are connected with two ends of the extension portion, respectively, wherein the cap includes a plurality of first protruding portions, each of the first protruding portions includes a first trough disposed corresponding to the first embedment portion.

17. The keyboard device as recited in claim 16, wherein an extending direction of the extension portion is the same as that of a length side of the cap.

18. The keyboard device as recited in claim 16, wherein a length of the cap corresponds to that of the extension portion.

19. The keyboard device as recited in claim 14, wherein the button further comprises:

a carrier member fixed to the base; and an actuating member slidably disposed on the carrier member, wherein the actuating member includes a second embedment portion, the cap further includes a second protruding portion having a second trough, and the second trough is disposed corresponding to the second embedment portion.

20. The keyboard device as recited in claim 19, wherein the second protruding portion is disposed in the second embedment portion and disposed against the cap.

21. The keyboard device as recited in claim 19, wherein the second protruding portion drives the actuating member to move and thus to be inserted into the carrier member when the cap moves toward the direction of the base.

22. The keyboard device as recited in claim 19, wherein each of two ends of the linking member includes an embedment section inserted into one of the engaging portions.

23. The keyboard device as recited in claim 22, wherein the engaging portion includes a pair of fixing arms which are approximately parallel with each other and flexible, and a distance between the pair of the fixing arms is smaller than a radial length of one of the embedment sections.

24. The keyboard device as recited in claim 22, wherein the linking member further includes two transition sections, two extension sections and a bend section, the bend section is connected with the extension sections, and each of the transition sections is connected with one of the embedment sections and one of the extension sections.

25. The keyboard device as recited in claim 24, wherein the base further includes two protruding limiting portions and the extension sections are engaged with the limiting portions, respectively.

26. The keyboard device as recited in claim 24, wherein when the cap moves toward the direction of the base, the restricting members drive the linking member to rotate so as to make the bend section contact the carrier member.

* * * * *